US006481922B2

(12) United States Patent
Boyd

(10) Patent No.: US 6,481,922 B2
(45) Date of Patent: Nov. 19, 2002

(54) APPARATUS AND METHOD FOR RE-MIXING SEGREGATED MATERIAL

(76) Inventor: Robert L. Boyd, 9856 Laclair Rd., Wilton, CA (US) 95693

( * ) Notice: Subject to any disclaimer, the term of this patent is extended or adjusted under 35 U.S.C. 154(b) by 0 days.

(21) Appl. No.: 09/839,657

(22) Filed: Apr. 19, 2001

(65) Prior Publication Data

US 2002/0154949 A1 Oct. 24, 2002

(51) Int. Cl.[7] ..... E01C 19/00
(52) U.S. Cl. ..... 404/81; 404/92
(58) Field of Search ..... 404/72, 75, 90, 404/91, 92, 101, 113, 81

(56) References Cited

U.S. PATENT DOCUMENTS

| | | | | | |
|---|---|---|---|---|---|
| 4,072,435 | A | * | 2/1978 | Coho et al. | 404/92 |
| 4,473,320 | A | * | 9/1984 | Register | 404/91 |
| 4,688,965 | A | * | 8/1987 | Smith et al. | 404/75 |
| 4,772,156 | A | * | 9/1988 | Craig | 404/101 |
| 5,002,426 | A | * | 3/1991 | Brown et al. | 404/92 |
| 5,035,534 | A | * | 7/1991 | Brock et al. | 404/92 |
| 5,531,542 | A | * | 7/1996 | Willis | 404/101 |
| 5,642,961 | A | * | 7/1997 | Campbell | 404/92 |
| 5,980,153 | A | * | 11/1999 | Plemons et al. | 404/92 |

* cited by examiner

*Primary Examiner*—Thomas B. Will
*Assistant Examiner*—Alex Pechhold
(74) *Attorney, Agent, or Firm*—R. Michael West; Boutin, Dentino, Gibson, DiGiusto, Hodell & West

(57) ABSTRACT

An apparatus and a method for re-mixing size and weight segregated Hot Mix Asphalt ("HMA") which is continuously discharging from a windrow elevator. The apparatus includes an auger assembly having first and second helical auger sections, mounted in spaced relation over respective ends of an auger connecting shaft. The first and second sections are of converging, opposite handedness. Owing to their orientation and handedness, the augers advance incoming material inwardly, toward a mixing zone, adjacent and around an intermediate portion of the connecting shaft. The apparatus also includes an auger housing, having an upper portion with a material inlet, and a lower portion with a material discharge. The auger assembly is mounted for rotation within the lower portion of the auger housing. The housing surrounds side, bottom and end portions of the auger sections. The material inlet is above and in communication with upper portions of the auger sections and the mixing zone. The material discharge is positioned below the mixing zone. Drive devices rotate the auger assembly, so that large pieces of material delivered to the upper portions of the auger sections are continuously advanced inwardly by the auger sections and commingled with small pieces of material delivered to the mixing zone. Under force of gravity, re-mixed material then exits through the material discharge.

21 Claims, 6 Drawing Sheets

46
62
59
63

46
63
66
62
59
20

46
63
66
62
59
20

59
54
20
56
61
58
57

54
20
56
61
58
57

54
20
58
56

APPARATUS AND METHOD FOR RE-MIXING SEGREGATED MATERIAL

BACKGROUND OF THE INVENTION

1. Field of the Invention

The invention relates generally to improvements in windrow elevators for use with asphalt paving machines. More specifically, the invention pertains to an apparatus and a method for re-mixing a continuous stream of segregated asphalt material so it assumes a homogeneous consistency, before it is deposited into the hopper of a paving machine.

2. Description of the Prior Art

The raw material for roadway asphalt, known in the industry as Hot Mix Asphalt ("HMA"), is usually prepared at a batch plant, relatively close to the paving site. In addition to the asphalt oil itself, HMA typically includes a mixture of sand, small rocks, and other filler material. For example, shredded rubber tires are sometimes added to the paving mixture, for recycling purposes.

After it is thoroughly mixed at an elevated temperature, the HMA is loaded into the hopper of a "belly dump" trailer, for transport from the batch plant to the paving site. It is imperative that the HMA is quickly transported to the site, distributed over the roadway, and processed into a smooth mat, before the material cools off. If the HMA cools off too much before the final roadway press is completed, the asphalt coated particles will not form a structurally integrated mat, and premature failure of the asphalt layer will likely result.

At the paving site, the belly dump trailer deposits the HMA in a windrow, extending along the center portion of the roadway. A typical windrow is approximately eighteen inches high, and two to four feet wide. A device known as a windrow elevator progressively collects up the leading edge of the windrow, transports the material upwardly and rearwardly, and then deposits the HMA into the hopper of a trailing paving machine. A paver conveyor in the floor of the paving machine passes the stream of HMA rearwardly, where it comes into contact with a horizontal dam. The dam is vertically spaced from the paver conveyor to level out the layer of HMA thereon. Then, the stream of HMA is discharged off the end of the conveyor, where it is deposited upon the roadway. The still-warm HMA is subsequently compressed by a roller into a firm mat, forming the smooth surface of the roadway.

One of the problems attendant with the manufacture, transport, and distribution of HMA in the process just described is a phenomenon termed "segregation", in the trade. As previously noted, the HMA is composed of different sized materials, ranging from sand granules to small rocks and various fill materials. Owing to the forces of agitation and gravity acting upon these materials during transport and handling, the larger, heavier particles and the smaller, lighter particles tend to separate, and collect in like groups. For example, when the windrow is formed, the smaller particles are concentrated in the central, elevated portion of the windrow and the larger particles are concentrated in the lateral, lower portions of windrow.

When the windrow elevator picks up these size and weight segregated materials, the larger particles and the smaller particles are transported up the elevator in the same relative locations as they existed in the windrow. In other words, across the width of the elevator, the larger particles are concentrated in the lateral regions, and the smaller pieces are concentrated in the middle region. And, when the HMA is deposited onto the paver conveyor, the large and small particles remain segregated from each other in the same fashion. As a consequence, when the HMA mat is formed, there is a concentration of large particles in the lateral portions of the roadway, and a concentration of small particles in the middle of the roadway. This non-homogeneous mixture of HMA across the roadway compromises the strength and integrity of the mat, eventually causing premature fracturing and breakup of the asphalt.

Therefore, the need exists for a device and a method for re-mixing segregated HMA into a uniform mixture, before it is deposited in the hopper of the paving machine.

The need also exists for an HMA re-mixing device which can easily be adapted to an existing windrow elevator, without necessitating major structural or system changes in the windrow elevator.

The need further exists for an HMA re-mixing device which is reliable and effective in moving the concentration of large particles from the lateral portions of the stream of HMA into the median portion of the stream for mixing, to produce a substantially homogeneous mixture of large and small particles in the HMA discharged into the paving machine.

Lastly, the need exists for an HMA re-mixing device which may easily be cleaned after use, without disassembly of components or systems.

SUMMARY OF THE INVENTION

The present invention is a re-mixing apparatus strategically mounted at the upper, discharge end of the windrow elevator. The re-mixing apparatus includes an auger assembly mounted for rotation within an auger housing. The auger assembly has first and second helical auger sections, mounted in spaced relation over respective ends of a connecting shaft, leaving an intermediate portion of the shaft therebetween. The auger housing substantially encloses the auger assembly, and in particular the sides, the lower portions, and the outer end portions of both auger sections. The housing also provides an elongated mixing zone, defined by the partially housed volume adjacent and around the intermediate portion of the connecting shaft.

A material inlet is provided at the upper portion of the auger housing to receive a relatively wide stream of material, continuously delivered by the windrow elevator. The material inlet is in communication with the upper portions of the augers and the mixing zone. A material discharge is located in the lower sidewall of the lower portion of the housing, immediately beneath the mixing zone.

At least one hydraulic motor provides rotational drive to a short extension of the connecting shaft, extending through an endwall of the housing. The motor thereby rotates the connecting shaft and the two attached auger sections. The auger sections are of converging, opposite handedness. Thus, when the auger sections are rotated, they are effective to move incoming material delivered from the lateral regions of the windrow elevator, toward the intermediate part of connecting shaft of the auger assembly. The material incoming from the middle region of the windrow elevator is fed directly toward the intermediate portion of the connecting shaft. The material transported inwardly by the auger sections is thereby re-mixed in the mixing zone adjacent and around the connecting shaft, into a homogeneous HMA composition. Then, under force of gravity, the re-mixed HMA material exits downwardly through the material discharge.

The upper portion of the housing is pivotally mounted to the frame of the windrow elevator. A locking mechanism is provided to maintain the housing in a normally closed position, for material re-mixing. To clean the re-mixing apparatus, the locking mechanism is first unlatched. Then, a hydraulic ram, extending between the frame of the windrow elevator and the lower end of the auger housing, is actuated. The force of the ram rotates the housing outwardly, away from the end of the windrow elevator, exposing the inner volume of the housing, including the augers. In this alternate open position, the inner walls of the housing and the augers may be cleaned using a combination of distillate chemicals and mechanical agitation. Withdrawing the hydraulic ram pulls the housing back toward the windrow elevator, placing the housing again into the closed position. Lastly, the locking mechanism is closed to secure the housing in place.

These and other features of the invention will now be described in further detail in the drawings and the detailed description of the preferred embodiment to follow.

DETAILED DESCRIPTION OF THE PREFERRED EMBODIMENT

Figure 1:
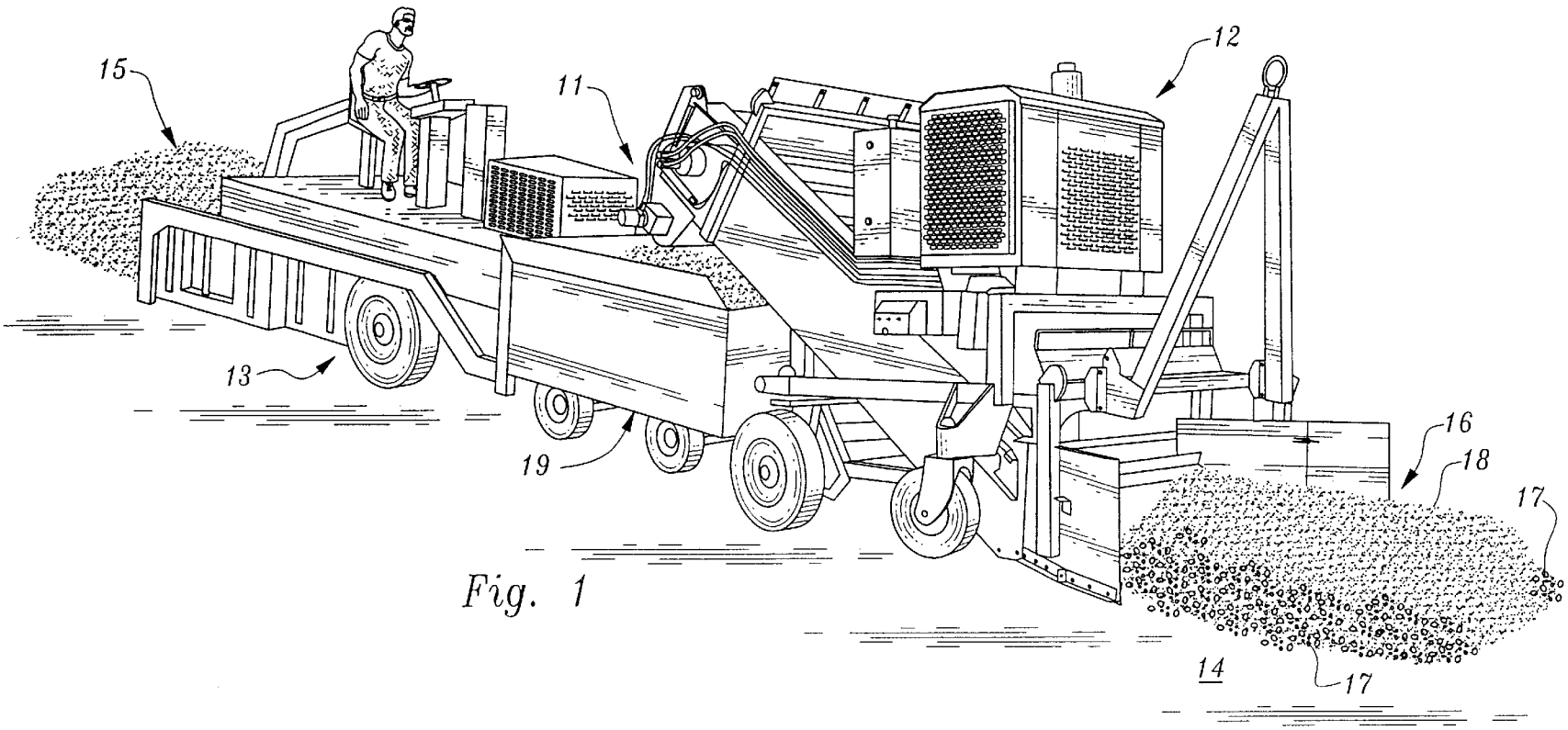
FIG. 1 is right front perspective view, showing a road paving operation utilizing the HMA re-mixing apparatus of the present invention.

Turning now to FIG. 1, the re-mixing apparatus 11 of the present invention is shown in conjunction with a windrow elevator 12 and a paving machine 13. In preparation for paving or re-paving of the roadway surface 14, a windrow 16 of Hot Mix Asphalt ("HMA") is laid down the center portion of the roadway.

Although the HMA has previously been thoroughly mixed at an offsite batch plant, by the time it has been transported to the paving site, a certain amount of material segregation has already occurred. In other words, the larger, heavier pieces of material, through the forces of gravity and transport shaking, have migrated and become concentrated in the lower portion of the belly dump trailer. These same forces produce an opposite result on the smaller and lighter pieces of material, which tend to concentrate toward the upper portion of the transported HMA. Then, when the belly dump trailer forms the windrow, the material becomes further segregated, with the large, heavy pieces 17 tending to roll off the inclined sides of the windrow, and becoming concentrated along the windrow's lateral margins. In contrast, the small, light pieces 18 remain in the center of the windrow, providing a higher concentration of light pieces in that area. So formed, the windrow 16 will typically be 18" in height, and 24" to 36" in width.

Figure 3:
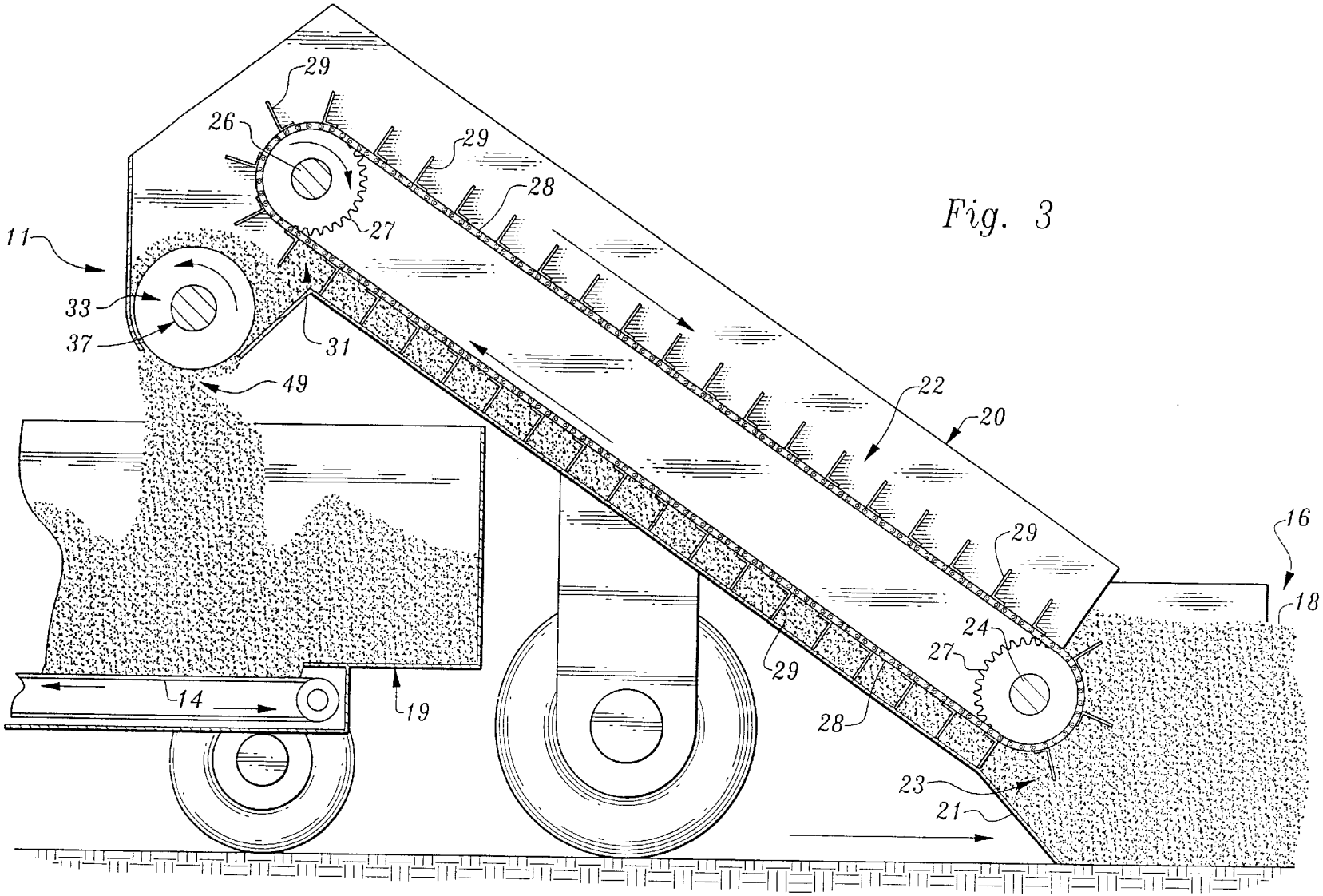
FIG. 3 is a longitudinal, cross-sectional view of the modified windrow elevator, generally showing the manner in which HMA is transported from a windrow into the hopper of a paving machine.

The windrow elevator 12, known in the trade as a "pickup machine", has the job of collecting the material from the leading edge of the windrow and elevating it sufficiently so it can be deposited into a hopper 19, located on the forward end of the paving machine 13. To that end, windrow elevator includes a downwardly and forwardly inclined blade 21, and an elevator assembly, generally designated by the numeral 22. As shown in FIG. 3, the elevator assembly 22 is mounted to an elevator frame 20, and is inclined upwardly and rearwardly. When the windrow elevator 12 advances forwardly, the blade 21 scrapes along the unpaved roadway surface, urging all of the HMA material upwardly, toward the inlet end 23 of the elevator assembly 22.

The elevator assembly 22 includes a lower shaft 24 and an upper shaft 26, each having a pair of sprockets 27, arranged in spaced relation along a respective shaft. A pair of parallel, endless drive chains 28 is trained around the sprockets 27. A plurality of angle-iron flights 29 spans the drive chains to provide material pushing surfaces. An elevator drive motor 30 rotates the upper shaft 26 in a clockwise fashion, which in turn moves the flights 29 along the indicated path. In this manner, the HMA is continuously urged from the elevator inlet end 23 to the elevator discharge end 31.

Figure 2:
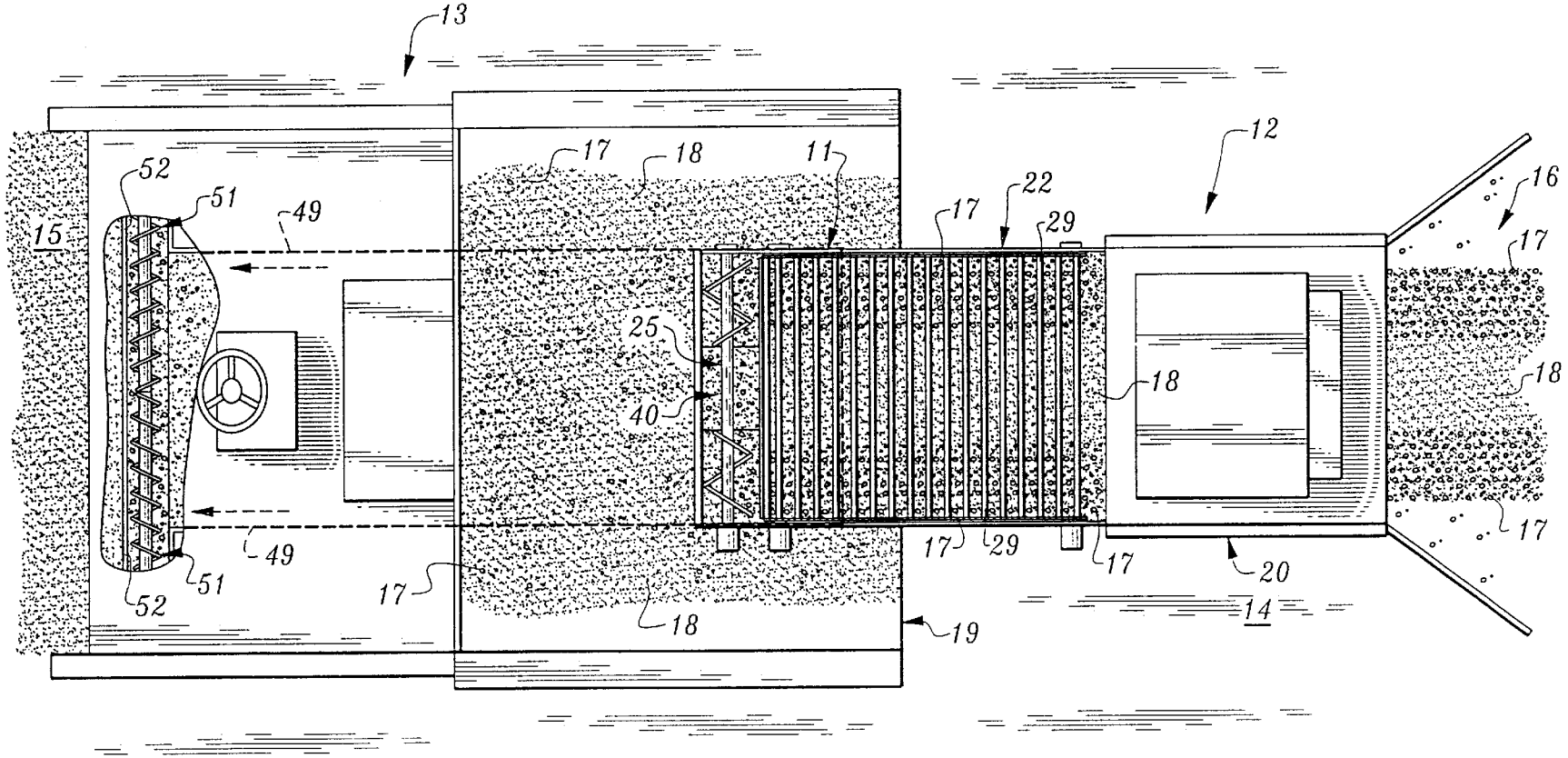
FIG. 2 is a top plan view of a windrow elevator, the re-mixing apparatus, and a paving machine, with selected portions of the machine housings broken away, to show how the segregated HMA is mixed into a homogeneous composition by the re-mixing apparatus.

It should be noted that the HMA being transported up the windrow elevator remains segregated, in substantially the same fashion as it existed in the windrow 16. Making particular reference to FIG. 2, the large, heavy pieces 17 are concentrated along lateral zones of the elevator assembly, and the small, light pieces 18 are concentrated in a central zone of the elevator assembly. Known prior art windrow elevators simply dump the continuous stream of segregated HMA from the elevator discharge end 31 directly into the hopper 19 of the paving machine 13. As a consequence, the material segregation which existed in the elevator assembly is maintained in the hopper, and the roadway mat ultimately laid reflects the same material segregation. A higher concentration of large material in the lateral regions of the roadway results in a rougher surface and a mat which is prone to premature fracturing and de-lamination.

To overcome this existing problem in the prior art, the apparatus 11 of the present invention re-mixes the HMA before it is dumped into the hopper 19 of the paving machine 13. This ensures that the HMA which is laid in the roadway mat 15 is a homogeneous composition, with the larger pieces being randomly and evenly interspersed throughout the smaller pieces of HMA.

To effect this re-mixing process, the apparatus 11 includes an auger assembly 25, having a first helical auger section 32 and a second helical auger section 33. Each of the first and second auger sections has a top portion 34 and an inner portion 36. Auger sections 32 and 33 are mounted in spaced relation over respective ends of a connecting shaft 37. An intermediate shaft portion 38 is defined by that length of connecting shaft between the inner portions 36 of the auger sections. It is important to note that the first and second auger sections are of converging, opposite handedness. By this it is meant that material which enters the top portions of the auger sections is advanced inwardly, toward the intermediate shaft portion 38. Although not critical, a diameter and pitch of 14" for the auger sections have proven satisfactory in practicing the invention.

The apparatus 11 also includes an auger housing 39, having an upper housing portion 41 with a material inlet 42, and a lower housing portion 43 with a material discharge 44. The auger housing also includes a first endwall 46 and a second endwall 47. The auger assembly is mounted for rotation within the lower housing portion 43, spanning the distance between the first and second endwalls. The auger housing 39 substantially surrounds the first and second auger sections, in closely spaced relation. Only ¼" or so of space exists between the outer periphery of the augers and the side and lower, inner sidewalls of the auger housing. This relatively close spacing is maintained so that smaller rocks and pebbles will be transported by the augers and not "cake" the sidewalls with trapped material.

In contrast, the top portions 34 of the auger sections are not enclosed by the housing, but rather are in communication with the material inlet 42. In addition, a mixing zone 40, defined by a partially housed volume in and around the intermediate shaft portion 38, is also in communication with the material inlet 42. Thus, the relatively wide, continuous stream of HMA incoming from the elevator discharge end 31 passes through the material inlet 42 and is delivered both into the top portions 34 of the auger sections and into the mixing zone 40.

It is significant to note that the HMA which is delivered to the top portions of the auger sections 32 and 33 has a relatively high concentration of large, heavy pieces 17. On the other hand, the incoming stream of HMA fed directly into the mixing zone 40 has a relatively high concentration of small, light pieces 18. This non-homogeneous distribution of material is clearly evident from examining the material passing through the windrow elevator assembly 22, in FIG. 2.

Figure 7:
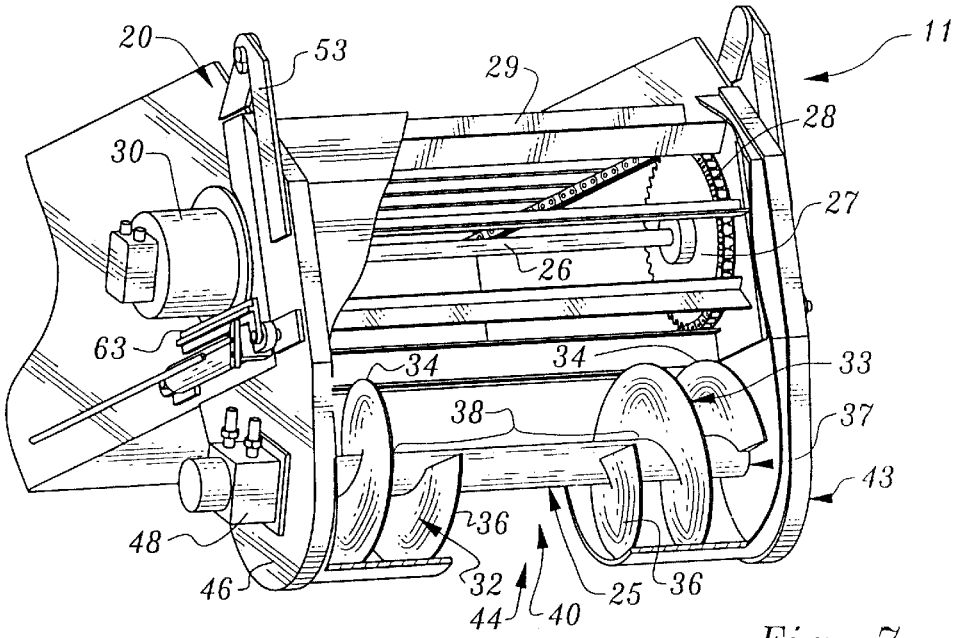
FIG. 7 is a perspective view of the upper end of the elevator, with a portion of the housing sidewall being broken away to show the first and second auger sections.

As shown in FIG. 7, the material discharge 44 is positioned immediately below the intermediate shaft portion 38. Although not particularly critical, the width of discharge 44 is generally coextensive with the longitudinal dimension of intermediate shaft portion 38.

The apparatus 11 also includes at least one hydraulic motor 48 for rotating the auger assembly 25. The connecting shaft 37 includes a short extension (not shown), which extends through the first endwall 46. The output shaft of motor 48, in turn, is mechanically coupled to the extension. The motor thereby rotates the auger assembly in counterclockwise fashion, as the shaft and an auger section are viewed in FIG. 3. Although it has proven convenient to use a hydraulic motor for rotating the auger assembly 25, one of ordinary skill in the art may choose to substitute an electric, a pneumatic, or another powered motor of suitable design to provide rotational forces. Also, another drive motor may be mounted on the second endwall 47, to drive the other end of connecting shaft 37.

In this manner, the concentration of generally large-sized HMA material which enters the material inlet adjacent the first and second helical auger sections, is advanced inwardly toward the centrally positioned mixing zone 40. Upon entering the mixing zone, the large-sized material is re-mixed and commingled with the relatively small-sized HMA material, which enters the material inlet directly over the mixing zone 40. Then, the re-mixed HMA material, which displays a random and generally uniform distribution of large and small sized material, exits through material discharge 44.

It is apparent that an alternative, equivalent constructions may be employed which provide the identical beneficial result. By appropriately reversing the handedness of the augers, and reversing the direction of rotation of the auger assembly, the HMA material will be moved inwardly and mixed centrally, in the same fashion. In addition, rather than using a pair of opposing augers to transport selective regions of the incoming stream toward the mixing zone, alternative means, such as a pair of inwardly and downwardly inclined troughs may be employed. A pair of conveyors, transversely positioned with respect to the windrow elevator and driven so as to transport material inwardly, may readily be substituted for the auger assembly, as well. Also, a rotating mixing paddle could be included within the mixing zone, to enhance the extent of material commingling.

Owing to the total length of the auger sections in comparison to the length of the mixing zone, approximately 60% of the material incoming from the elevator assembly 22 is transported inwardly into the mixing zone. However, because this material has a high concentration of large pieces of HMA, approximately 80% of the large pieces are re-mixed through this process.

The auger sections are also effective to "break up" large agglomerations or balls of HMA material which may have formed upstream of the apparatus. This phenomena is more common where the HMA material includes a rubberized mixture.

It should also be noted that the auger assembly is rotated at such a speed that it "overruns" the stream of material discharged from the elevator assembly. In other words, material is always transported away through the auger sections, faster than it is entering the material inlet. This ensures that there will be no jamming or build-up of HMA material at the material inlet. In practice, the actual speed of rotation of the auger assembly varies in accordance with the forward speed of the windrow elevator, but a typical speed of material transport for the augers would be approximately 32 feet per second (72 RPM).

The method of carrying out the present invention requires that the incoming material be size or weight segregated, with the larger, heavier material being concentrated in the lateral regions of an incoming stream, and with the smaller, lighter material being concentrated in a middle region of an incoming stream. The smaller, lighter material is delivered from the incoming stream into a mixing zone. The process further entails the steps of diverting the incoming material from each of the lateral regions and transporting it inwardly into the mixing zone. Then, to complete the process, the heavier and lighter materials are commingled in the mixing zone to form a homogeneous material mix.

Returning now to the machines carrying out the paving process, the re-mixed HMA material exits from the apparatus 11 through the material discharge 44, and is deposited into the hopper 19 of the paving machine 13. The paving machine 13, also known in the industry as a "laydown machine", includes an elongated, fore and aft conveyor 49. The conveyor 49 extends from the front of the hopper, to the rear end of the paving machine. The floor of the hopper 19 may be slightly inwardly inclined toward the conveyor 49, or it may simply be flat. In either case, the re-mixed HMA builds up on the conveyor and in adjacent regions, as suggested by FIG. 3. The conveyor 49 transports the HMA material rearwardly, toward a material distribution auger 51. This auger is effective to transport a portion of the material delivered by the conveyor, laterally. By way of example only, the width of the conveyor 49 may be 5 feet, or so, and the width of the auger may be 12 feet, and up to 22 feet, on occasions. Downstream from the output of the auger 51 is a horizontal dam 52. HMA material builds up against the dam, so that the material exiting onto the roadway is of uniform height, and contains no voids. Following this material laydown process, the HMA material is compressed and flattened by a roller, to complete formation of the roadway mat 15.

Figure 8:
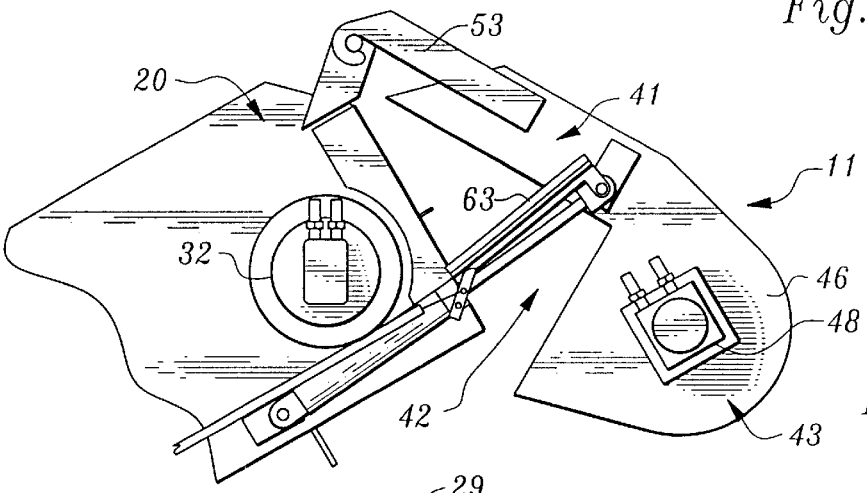
FIG. 8 is a side elevational view as in FIG. 5, but showing the auger housing rotated into an open position for cleaning.
Figure 9:
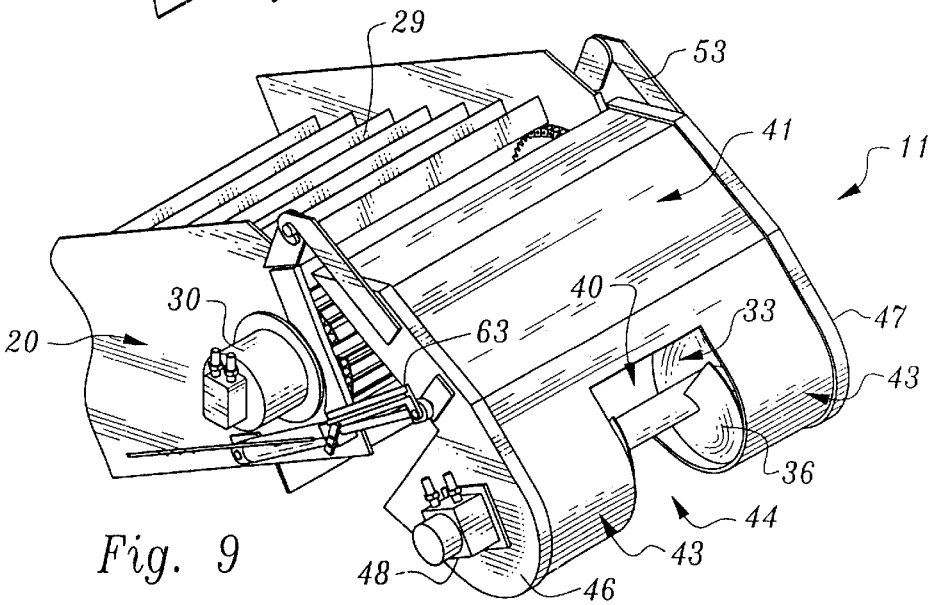
FIG. 9 is a perspective view as in FIG. 6, but showing the auger housing rotated into an open position, for cleaning.

Because HMA material is asphalt-based, cleanup of the material at the end of the work day poses unique problems. When cooled down, HMA material becomes both hard and sticky, adhering to all exposed surfaces of the various machines used in the paving process. To facilitate cleaning of the interior of the apparatus 11, the upper housing portion 41 includes extension arms 53, pivotally attached to the elevator frame 20. This pivotal attachment allows the apparatus to be rotated from a normally closed position, for use (FIG. 7), to an open position, for cleaning (FIGS. 8 and 9).

A housing locking mechanism 54, shown in various positions in FIGS. 10A–B through FIGS. 12A–B, inclusive, is used to secure the housing either in a closed or an open position. Most of the components of the locking mechanism are mounted to one side of the elevator frame 20, adjacent the apparatus 11.

Figures 10A, 10B, 11A, 11B, 12A, 12B:
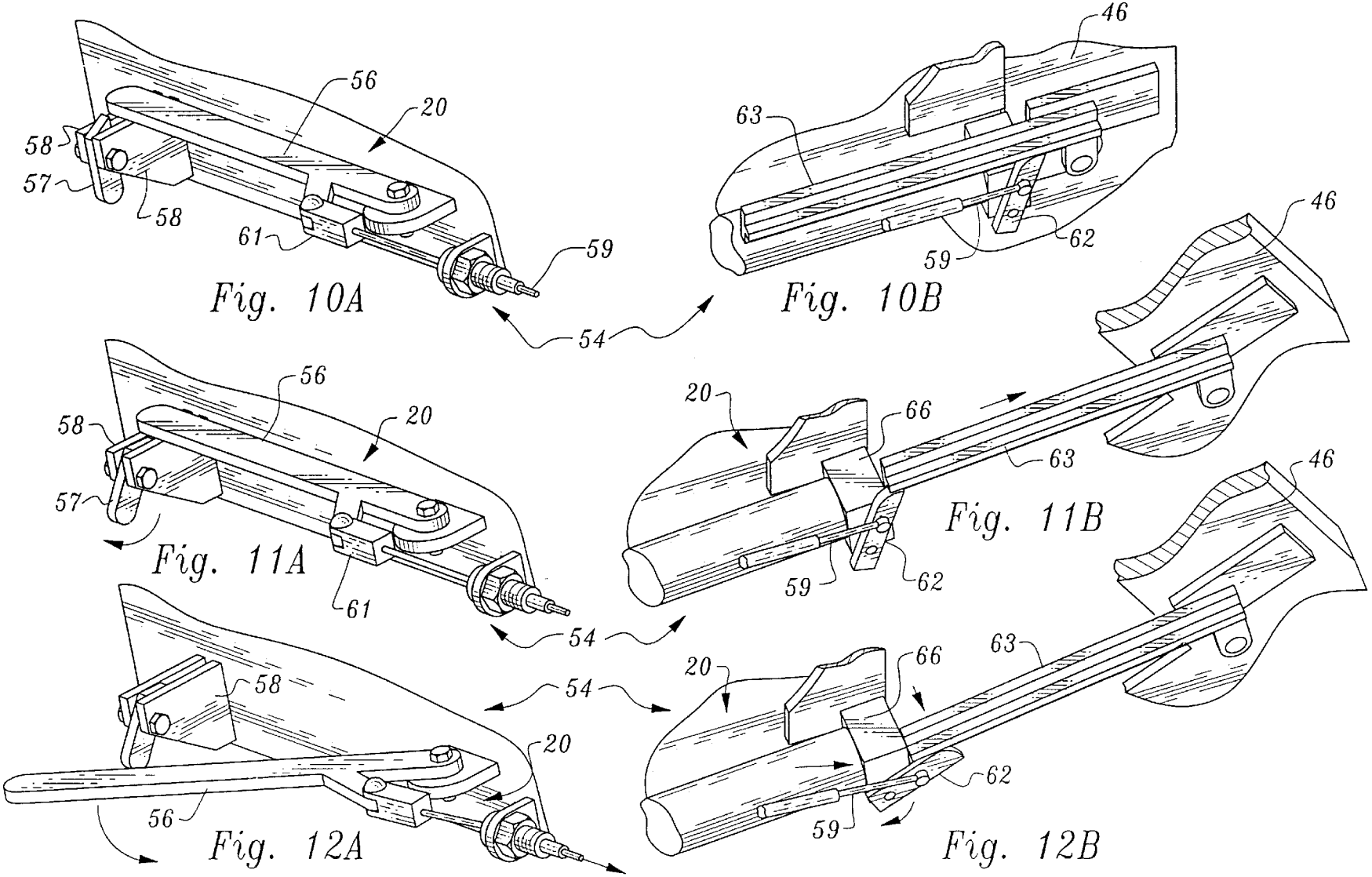
FIGS. 10A and 10B are perspective views, showing associated components of the auger housing locking mechanism in a locked position.
FIGS. 11A and 11B are perspective views as in FIGS. 10A and 10B, but showing the latch bar rotated to a release position and the end of the prop bar over the support arm; and, FIGS. 12 and 12B are perspective views as in FIGS. 10A and 10B, but showing the lever arm rotated into an unlocked position, and the support arm and the prop bar in lowered positions.

Turning first to FIG. 10A, a lever arm 56 is shown in a locked position, held securely by a latch bar 57 and two support plates 58. Latch bar 57 normally rests in a vertical position, under the force of gravity. One end of a sheathed cable 59 is connected by a clevis 61 to an extension of the lever arm 56. The other end of the sheathed cable 59, shown in FIG. 10B, is connected to a pivotally mounted support arm 62. When lever arm 56 is locked, cable 59 is in a fully withdrawn position. This, in turn, maintains support arm 62 in an upright position. A prop bar 63, is pivotally attached at one end to the first endwall 46 of the housing 39. Thus, when the lever arm 56 is locked, the prop bar 63 is supported by support arm 62 (see, FIG. 10B).

Figure 4:
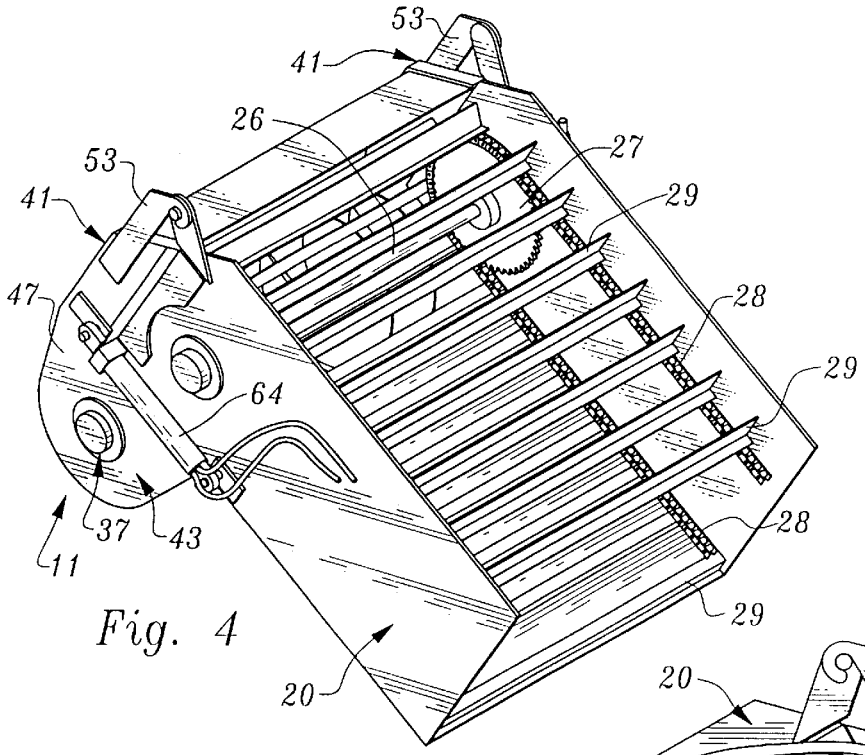
FIG. 4 is a perspective view of the upper end of the windrow elevator, with the top cover removed to show the chain and flight construction of the elevator.
Figure 5:
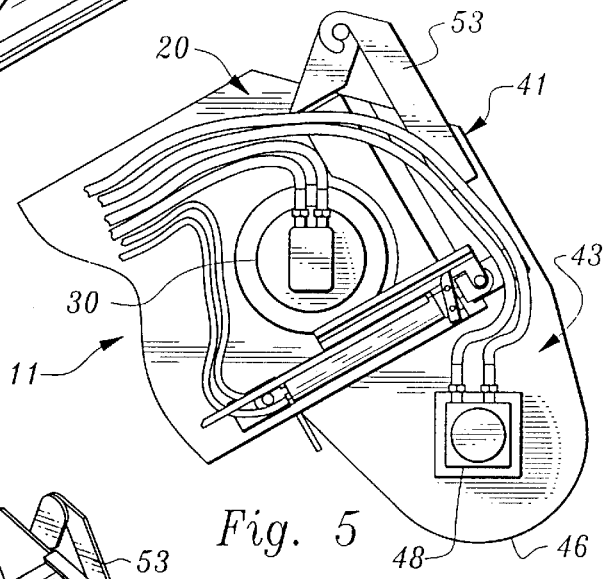
FIG. 5 is an elevational view of the left-hand end of the auger housing and the upper end of the elevator.
Figure 6:
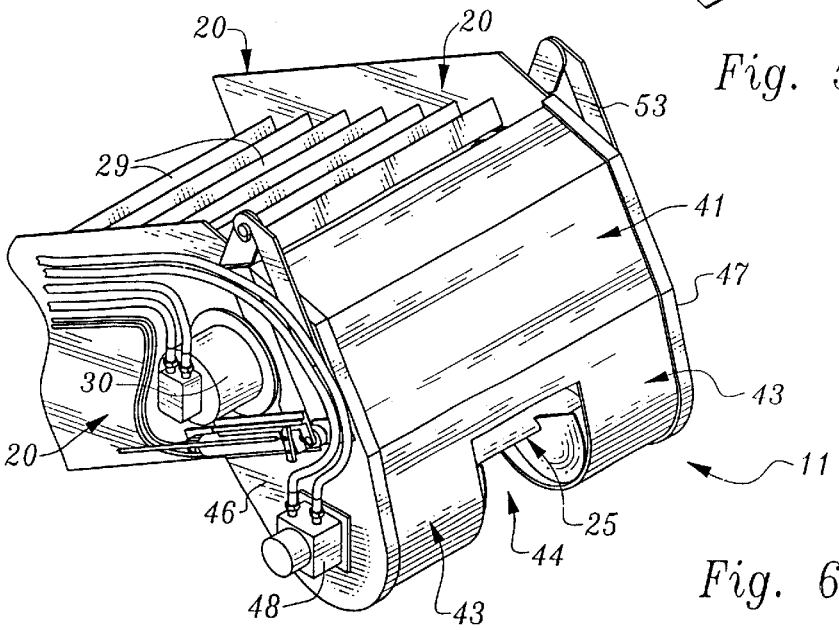
FIG. 6 is a perspective view of the upper end of the elevator and the auger housing, showing the material discharge cutout in the lower sidewall of the auger housing.

On the other end of the apparatus, a hydraulic ram 64 extends between elevator frame 20 and second endwall 47 (see, FIG. 4). When the operator is ready to clean the apparatus, the hydraulic ram 64 is actuated, pivoting the apparatus away from the upper end of the windrow elevator 12. When the ram is fully extended, the prop bar 63 is drawn away from the frame 20, into the position shown in FIG. 11B. The operator then swings the bottom of the latch bar 57 upwardly, so that the lever arm 56 clears the top of the latch bar, allowing the lever arm to be drawn outwardly (see, FIG. 11A).

Outward movement of the lever arm urges the cable 59 forwardly, pivoting the support arm into a fully lowered position (see, FIG. 12B). Under gravity, the prop bar now drops downwardly, upon a ledge (not shown). In this lowered position, the prop bar 63 abuts the adjacent end of stop 66. This provides a secure brace for the apparatus in its fully open position, so that the inner walls of the housing and the auger assembly may safely be cleaned.

To close the apparatus, and ready it for operation once again, the process is reversed, by rotating the lever arm into a withdrawn position, thereby raising up the prop bar so that it clears the stop 66, and then fully withdrawing the hydraulic ram 64.

It will be appreciated, then, that I have described a re-mixing apparatus and a method for improving the homogeneity and uniformity of particle distribution in HMA material used during roadway paving.

What is claimed is:

1. An apparatus for re-mixing relatively large-sized and relatively small-sized segregated material, comprising:

a. an auger assembly having a first helical auger section and a second helical auger section, both of said first and second sections having top portions and inner portions, said first and second auger sections being mounted in spaced relation over respective ends of a connecting shaft, said inner portions of said first and second sections defining an intermediate shaft portion therebetween, said first and second auger sections further being of converging, opposite handedness, so as to advance the relatively large-sized segregated material inwardly toward said intermediate shaft portion;

b. an auger housing having an upper portion with a material inlet and a lower portion with a material discharge, said housing further having a first endwall and a second endwall, said auger assembly being mounted for rotation within said lower portion between said first and second endwalls, said housing substantially surrounding said first and second auger sections but leaving said top portions and said intermediate shaft portion exposed to said material inlet, said housing further including a mixing zone adjacent and around said intermediate shaft portion, with said material discharge being located below said intermediate shaft portion; and, c. drive means for rotating said auger assembly, whereby the relatively large-sized segregated material entering said material inlet adjacent said first and second helical sections is advanced toward said intermediate shaft portion, and is re-mixed and commingled in said mixing zone with the relatively small-sized segregated material entering said material inlet adjacent and around said intermediate shaft portion, the re-mixed and commingled material thereafter passing through said material discharge.

2. An apparatus as in claim 1 in which segregated material entering said material inlet is segregated by size, having a concentration of larger material pieces entering said material inlet into said first and second auger sections and having a concentration of smaller material pieces entering said material inlet into said mixing zone.

3. An apparatus as in claim 1 in which said drive means is a hydraulic motor.

4. An apparatus as in claim 1 in which said connecting shaft of said auger assembly includes ends supported by bearings on said first endwall and said second endwall.

5. An apparatus as in claim 1 in which said material inlet is at least twice as wide as said material discharge.

6. An apparatus as in claim 1 in which said upper portion of said housing is mounted to an upper, discharge end of a windrow elevator.

7. An apparatus as in claim 6 in which said housing is pivotally mounted to said upper discharge end of said windrow elevator.

8. An apparatus as in claim 7 including means to move said housing from a normally closed position over said discharge end for re-mixing operation, and an open position rotated away from said discharge end, for cleaning.

9. An apparatus as in claim 8 further including locking means to secure said housing in said normally closed position, and bracing means to hold said housing in said open position.

10. An apparatus as in claim 6 in which the segregated material is hot mix asphalt, and in which the asphalt delivered to said auger sections by said windrow elevator includes a relatively high concentration of large sized pieces and in which the asphalt delivered to said intermediate shaft portion by said windrow elevator includes a relatively high concentration of small sized pieces.

11. An apparatus for re-mixing an incoming stream of segregated material having opposing lateral regions straddling a middle region, in which the lateral regions contain a higher concentration of larger pieces of material, and in which the middle region contains a higher concentration of smaller pieces of material, comprising:

a. means for advancing larger pieces of material inwardly from the lateral regions to a central mixing zone, said advancing means including an auger assembly having first and second auger sections, both of said first and second sections having top portions and inner portions, said first and second auger sections being mounted in spaced relation over respective ends of a connecting shaft, said connecting shaft including an intermediate shaft portion which is located between said inner portions of said auger sections and which passes through said mixing zone, said first and second auger sections further being of converging, opposite handedness, so as to advance the material inwardly toward said intermediate shaft portion;

b. housing means for substantially surrounding said advancing means, said housing means including an upper portion having a material inlet in communication with the incoming stream, said material inlet being above said advancing means and said mixing zone, and said housing means further including a lower portion having a material discharge below said mixing zone; and, c. drive means for rotating said advancing means, whereby material from the lateral regions entering said material inlet above said advancing means is advanced toward said mixing zone, and is re-mixed and commingled in said mixing zone with material from the middle region directly entering said mixing zone, before exiting through said material discharge.

12. An apparatus as in claim 11, in which said housing means further includes a first endwall and a second endwall, said auger assembly being mounted for rotation within said lower portion of said housing between said first and second endwalls.

13. An apparatus as in claim 11 in which said drive means is a hydraulic motor.

14. An apparatus as in claim 12 in which said connecting shaft of said auger assembly includes ends supported by bearings on said first endwall and said second endwall.

15. An apparatus as in claim 11 in which said material inlet is at least twice as wide as said material discharge.

16. An apparatus as in claim 11 in which said upper portion of said housing is mounted to an upper, discharge end of a windrow elevator.

17. An apparatus as in claim 16 in which said housing is pivotally mounted to said upper discharge end of said windrow elevator.

18. An apparatus as in claim 17 including means to move said housing from a normally closed position over said discharge end for re-mixing operation, to an open position rotated away from said discharge end, for cleaning.

19. An apparatus as in claim 18 further including locking means to secure said housing in said normally closed position, and bracing means to hold said housing in said open position.

20. An apparatus as in claim 16 in which the segregated material is hot mix asphalt.

21. A method for re-mixing size-segregated material comprising the steps of:

a. providing a continuous stream of segregated material across a width having opposing lateral regions straddling a central region, said lateral regions having a relatively high concentration of large-sized pieces of said material and said central region having a relatively high concentration of small-sized pieces of said material;

b. continuously moving said large-sized pieces from said lateral regions inwardly toward a mixing zone;

c. continuously delivering said small-sized pieces from said central region to said mixing zone; and, d. continuously re-mixing said large-sized pieces and said small sized pieces in said mixing zone, so as to achieve a substantially uniform distribution of large and small-sized pieces in the re-mixed material.

* * * * *